US008398269B1

(12) United States Patent
Loomis

(10) Patent No.: US 8,398,269 B1
(45) Date of Patent: Mar. 19, 2013

(54) DECORATIVE HOLOGRAPHIC ORNAMENT

(75) Inventor: Jason Loomis, Decatur, GA (US)

(73) Assignee: Loominocity, Inc., Napa, CA (US)

( * ) Notice: Subject to any disclaimer, the term of this patent is extended or adjusted under 35 U.S.C. 154(b) by 104 days.

(21) Appl. No.: 12/986,066

(22) Filed: Jan. 6, 2011

Related U.S. Application Data

(60) Provisional application No. 61/292,737, filed on Jan. 6, 2010.

(51) Int. Cl.
*F21S 4/00* (2006.01)

(52) U.S. Cl. ..... 362/249.16; 362/186; 362/249.14; 362/806

(58) Field of Classification Search ..... 362/249.14, 362/249.15, 249.16, 186, 806
See application file for complete search history.

(56) References Cited

U.S. PATENT DOCUMENTS 4,417,299 A * 11/1983 Rupp ..... 362/186
4,947,299 A * 8/1990 Lin ..... 362/161
5,034,547 A * 7/1991 Smith et al. ..... 552/235
5,237,491 A * 8/1993 McCarter ..... 362/186
5,609,928 A * 3/1997 Yedlin et al. ..... 428/5
6,254,247 B1 * 7/2001 Carson ..... 362/101
6,341,874 B1 * 1/2002 Rubin ..... 362/103
7,118,249 B2 * 10/2006 Hsu et al. ..... 362/249.06
7,520,633 B2 * 4/2009 Hornsby et al. ..... 362/231
7,854,532 B2 * 12/2010 Myers, Jr. et al. ..... 362/249.14
8,002,456 B2 * 8/2011 Chien ..... 362/640
8,128,259 B2 * 3/2012 Myers et al. ..... 362/249.14
2004/0233668 A1 * 11/2004 Telfer et al. ..... 362/252
2006/0262529 A1 * 11/2006 Hornsby et al. ..... 362/231
2006/0291217 A1 * 12/2006 Vanderschuit ..... 362/363

* cited by examiner

*Primary Examiner* — John A Ward
(74) *Attorney, Agent, or Firm* — Larry D. Johnson

(57) ABSTRACT

A decorative holographic ornament has a body of generally clear or translucent hard plastic or similar material, of a size suitable for use as a tree ornament or the like. Molded holographic film is applied to the inside surface of the ornament, so that it is protected by the plastic body. An inner wire spool or core is supported in the center of the ornament, and LED wire is wrapped through or around the core. When the LED lights on the LED wire are illuminated, holographic images of the LEDs are generated and visible from the outside of the ornament with a pleasing "three-dimensional" aesthetic effect.

10 Claims, 2 Drawing Sheets

DECORATIVE HOLOGRAPHIC ORNAMENT

CROSS REFERENCE TO RELATED APPLICATIONS

The present application claims the benefit of the filing date of U.S. Provisional Patent Application Ser. No. 61/292,737, filed Jan. 6, 2010. The foregoing application is incorporated by reference in its entirety as if fully set forth herein.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to lights and decorations, and more particularly to an improved decoration in the form of a decorative holographic ornament.

BACKGROUND INFORMATION AND DISCUSSION OF RELATED ART

U.S. Pat. No. 3,731,081 to Yellin discloses an electrically illuminated ornamental display comprising a body member of any shape provided with a plurality of spaced body socket openings which are adapted to receive and support a decorative lighting string of lights, which string of lights comprises a plurality of electrical sockets each with a bulb therein, with the electrical sockets connected by electrical conductors to form a string of lights, said body member adapted to receive said string of lights by inserting the electrical sockets from the rear of the body member into said body sockets, with the body member hiding the electrical conductors. The body member and the body sockets are integrally molded of a plastic material.

U.S. Pat. No. 5,410,459 to Yang describes a lighting ornament having a first and a second shell arranged to mesh with each other. One of the shells has a raised portion to form a compartment adapted to receive a string of lights when the shells are meshed. Packing material is arranged on the edge portions of one of the shells so that the chamber is hermetically sealed and fastened by the packing material when the shells are meshed.

U.S. Pat. No. 5,645,343 to Rinehimer teaches a light-string holder having two hubs with a plurality of receptacles. One of the hubs attaches to an external suspension device. The light-string holder has a plurality of lamp-cluster holders fabricated from a translucent material. The lamp-cluster holders have a central beam member with two connectors configured to mate with corresponding receptacles on each hub, and a tapered straight edge configured to mate with the other tapered straight edges of the other lamp-cluster holders, and a peripheral beam member with a plurality of lamp clamps recessed below the peripheral edge of the peripheral beam member. Each of the lamp clamps have a C-shaped member comprising a circular arc greater than 180 degrees and of a diameter equal to or less than the diameter of a lamp socket, and where both the central beam member and the peripheral beam member have an I-beam cross section and a plurality of holes through the land area of the I-beam.

U.S. Pat. No. 5,772,312 to Pihl-Niederman, et al. discloses a lighted ornament including a hollow shell which houses a portion of a string of lights which exit at opposing ends through one or two cord apertures in the shell. The light bulbs housed within the hollow shell extend through light bulb apertures in the hollow shell, or alternatively, translucent members are secured to the hollow shell to communicate light from the light bulbs and thereby illuminate the ornament. The lighted ornament creates a stunning lighted ball or other shaped ornament such as a candy cane, reindeer, Christmas tree, etc. The lighted ornaments are suited for indoor or outdoor use and may be used year after year.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an improved decoration in the form of a decorative holographic ornament. The ornament is preferably constructed with a body of generally clear or translucent hard plastic or similar material, of a size suitable for use as a tree ornament or the like. Molded holographic film is preferably adhered or otherwise applied to the inside surface of the ornament, so that it is protected by the plastic body. An inner wire spool or core is supported in the center of the ornament (as by being sandwiched in place by two halves of the ornament), and LED wire (thin wire with LED lights embedded and then covered with epoxy that acts as an insulator and lens) is wrapped through or around the core. When the LED lights on the LED wire are illuminated, holographic images of the LEDs are generated and visible from the outside of the ornament with a pleasing "three-dimensional" aesthetic effect.

Power may be supplied to the LED wire by an external battery pack. Alternatively, an internal battery pack may be incorporated into the core, with the LED wire wrapped around the outside of the core, and a DC connector may be incorporated into the outer shell of the ornament to enable recharging of the internal battery pack. A further alternative provides a plug-in power source, such as a C-7 or C-9 screw base so that the inventive ornament can be installed on an existing light string.

A timer and/or controller, which may be incorporated into the battery pack, enables selection of a desired on/off cycle for the LED lights (e.g., 6 hours on, 18 hours off), and various functions such as random phasing, steady on, and/or random twinkle of the LED lights. Two or more LED wire circuits may be employed and alternately illuminated for a pleasing effect.

The ornament body of the inventive structure could be formed as different shapes, such as a sphere, tree (cone), cube, or other shape. The holographic film can be selected to generate any desired pattern or image, such as snowflakes, stars, or letters.

It is therefore an object of the present invention to provide a new and improved decorative article.

It is another object of the present invention to provide a new and improved decoration in the form of a decorative holographic ornament.

A further object or feature of the present invention is a new and improved ornament that can be selectively controlled for random phasing, steady on, or random twinkle.

An even further object of the present invention is to provide a novel ornament with a self-contained power supply.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
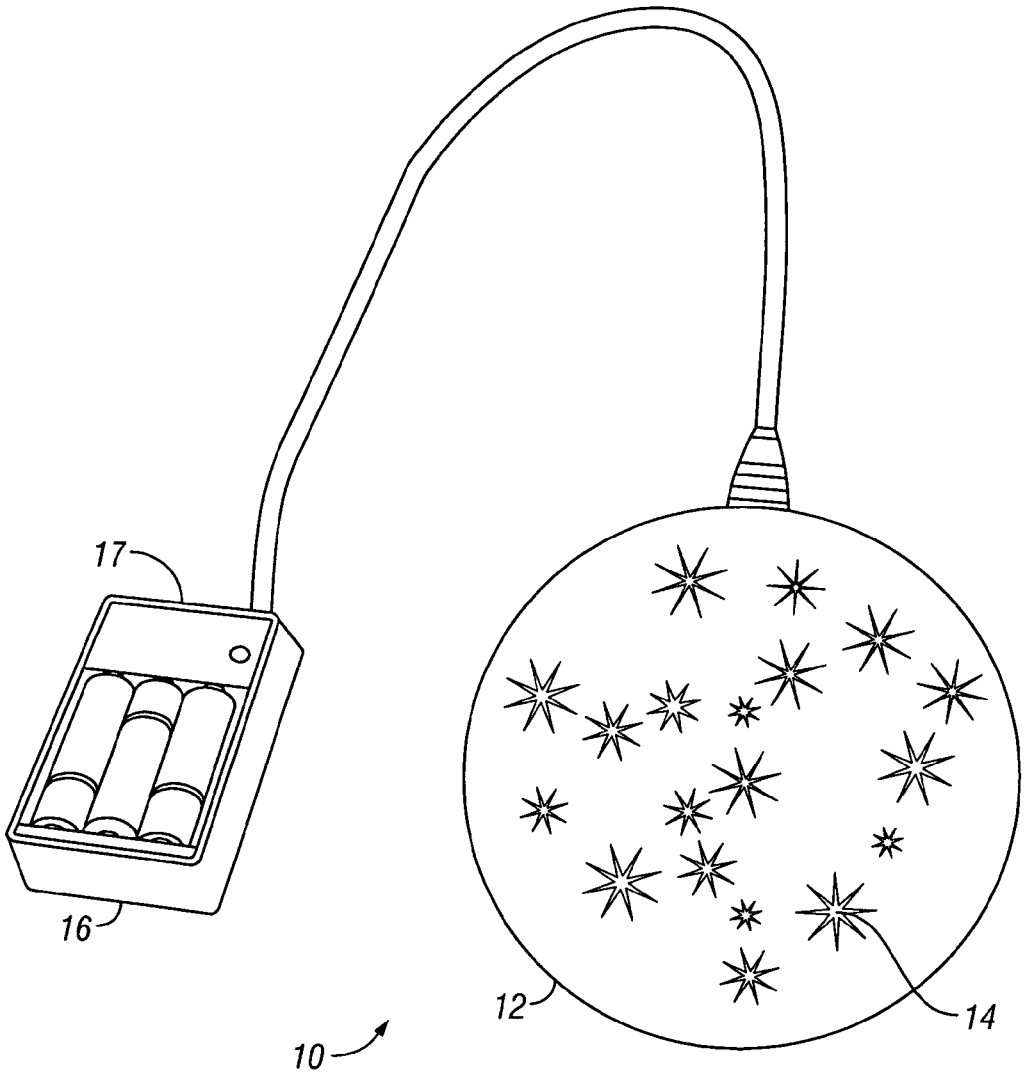
FIG. 1 is a front elevation view of a decorative holographic ornament and associated external battery pack.
Figure 2:
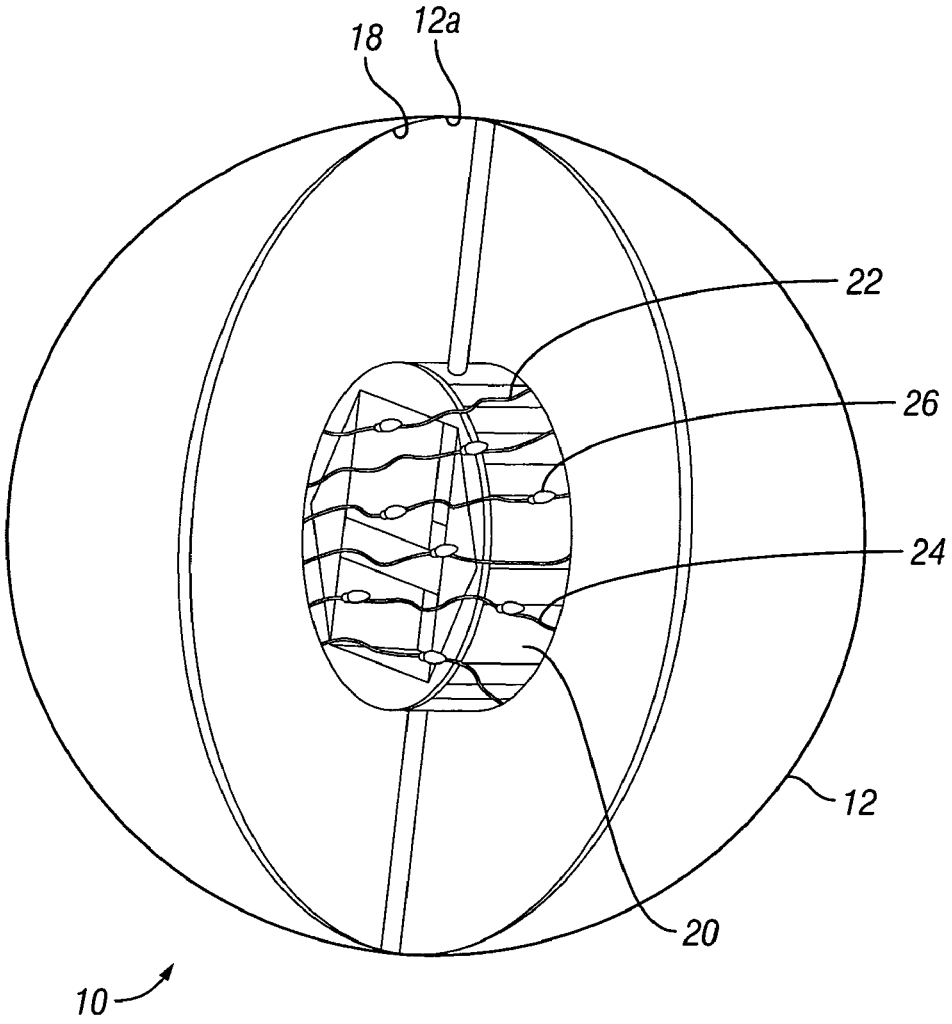
FIG. 2 is a partially cutaway view of a decorative holographic ornament illustrating the holographic film applied to the inside surface of the ornament, inner core supported in the center of the ornament, and LED wire wrapped around the core.

Referring to FIGS. 1 and 2, wherein like reference numerals refer to like components in the various views, there is illustrated therein a new and improved decorative holographic ornament, generally denominated 10 herein.

FIG. 1 is a front elevation view of the decorative holographic ornament 10. The ornament 10 is preferably constructed as a hollow sphere 12 or other shape of generally clear or translucent hard plastic or similar material, of a size suitable for use as a tree ornament or the like. When the LED lights on the LED wire inside the hollow sphere 12 are illuminated, holographic images 14 of the LEDs are generated and visible from the outside of the ornament with a pleasing aesthetic effect. Power may be supplied to the LED wire by an external battery pack 16, which may include a timer and/or controller 17 for the LEDs.

FIG. 2 is a partially cutaway view of the decorative holographic ornament 10 illustrating the holographic film 18 applied to the inside surface 12*a* of the ornament, such that the hard plastic sphere 12 protects the holographic film from damage. An inner core, such as a flat perforated plastic disc 20, is supported in the center of the ornament, and a pair of LED wire circuits 22, 24 each with a plurality of LED lights 26 are wrapped through or around the core or through the perforations in the core. In the preferred embodiment, the LEDs 26 on the LED wires 22, 24 (e.g., for a total of thirty-six LED lights +/−) are randomly spaced around the core, typically one to two inches from the holographic film 18 for best holographic effect. The two LED wire circuits 22, 24 may be alternately phased on and off for a pleasing effect.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A decorative ornament comprising:

a substantially transparent hollow body portion having an inside surface;

a substantially transparent holographic film applied to said inside surface;

an inner core supported proximate the center of said body portion;

a plurality of LED lights attached to said inner core; and a power supply connected to said LED lights, wherein when said plurality of LED lights are illuminated, holographic images of said plurality of LED lights are generated by said holographic film and visible from the outside of said decorative ornament.

2. The decorative ornament of claim 1 wherein said plurality of LED lights comprises LED wire.

3. The decorative ornament of claim 2 wherein said LED wire is wrapped around said inner core.

4. The decorative ornament of claim 1 wherein said power supply comprises a battery pack.

5. The decorative ornament of claim 1 wherein said inner core comprises a flat perforated plastic disc.

6. The decorative ornament of claim 1 wherein said plurality of LED lights comprises a plurality of LED wire circuits.

7. The decorative ornament of claim 6 wherein said plurality of LED wire circuits are alternately phased on and off.

8. The decorative ornament of claim 1 further including a controller enabling selection of a desired on/off cycle for said plurality of LED lights.

9. The decorative ornament of claim 1 wherein said hollow body portion comprises a sphere.

10. The decorative ornament of claim 1 wherein said plurality of LED lights are positioned from one to two inches from said holographic film on said body portion inside surface.

* * * * *